US011427398B2

(12) United States Patent
Draghetti

(10) Patent No.: US 11,427,398 B2
(45) Date of Patent: Aug. 30, 2022

(54) SPACING SUPPORT FOR PACKETS FOR SMOKING ARTICLES, SPACING KIT, PACKAGE CONTAINING SAID SPACING KIT AND METHOD TO ASSEMBLE A SPACING KIT

(71) Applicant: PHILIP MORRIS PRODUCTS S.A., Neuchatel (CH)

(72) Inventor: Fiorenzo Draghetti, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 93 days.

(21) Appl. No.: 17/055,205

(22) PCT Filed: May 30, 2019

(86) PCT No.: PCT/EP2019/064139

§ 371 (c)(1),
(2) Date: Nov. 13, 2020

(87) PCT Pub. No.: WO2019/229212

PCT Pub. Date: Dec. 5, 2019

(65) Prior Publication Data

US 2021/0163216 A1 Jun. 3, 2021

(30) Foreign Application Priority Data

May 30, 2018 (IT) ..... 1020180005837

(51) Int. Cl.
*B65D 85/10* (2006.01)
*B65B 19/18* (2006.01)
(Continued)

(52) U.S. Cl.
CPC ..... *B65D 85/1072* (2013.01); *B65B 19/18* (2013.01); *B65D 5/48034* (2013.01); *B65D 77/003* (2013.01); *B65D 2577/043* (2013.01)

(58) Field of Classification Search
CPC ..... B65D 85/1009; B65D 85/1072; B65D 5/48034; B65D 77/003; B65D 2577/043
(Continued)

(56) References Cited

U.S. PATENT DOCUMENTS 2,346,788 A 4/1944 Rice
3,721,335 A 3/1973 Grant
(Continued)

FOREIGN PATENT DOCUMENTS

CA 1 021 296 11/1977
EP 0 542 449 5/1993

OTHER PUBLICATIONS

Search Report and Written Opinion for PCT/EP2019/064139 dated Jul. 23, 2019 (12 pages).

*Primary Examiner* — Jacob K Ackun
(74) *Attorney, Agent, or Firm* — Mueting Raasch Group

(57) ABSTRACT

A spacing support (11) and a spacing kit (10) for packets (100) of smoking articles configured to support in an orderly manner a plurality of packets arranged on two adjacent rows. The spacing support (11) comprises two containing drawers (12) arranged adjacent to each other and each defining a respective housing (13) for a corresponding row of packets, which extends in a longitudinal direction (X), and an access aperture (17) through which the packets (100) can be introduced and extracted from the housing (13). Each containing drawer (12) comprises a bottom wall (14) from which a pair of side walls (15) extends, each of these walls (14, 15) being configured to come into contact with a respective wall (101, 102) of the packet (100), wherein at least one of the side walls (15) comprises a plurality of positioning elements (18) projecting toward the inside of said housing (13), made as pre-cut fins (19) integrated into the side wall (15), and configured to delimit positioning compartments (26), in which each of said packets (100) is
(Continued)

stably arranged and held in a static manner, in said longitudinal direction (X), with respect to said housing (13).

14 Claims, 4 Drawing Sheets

(51) Int. Cl.
*B65D 5/49* (2006.01)
*B65D 77/00* (2006.01)

(58) Field of Classification Search
USPC ..... 206/256, 257, 258
See application file for complete search history.

(56) References Cited

U.S. PATENT DOCUMENTS

| | | | | | |
|---|---|---|---|---|---|
| 3,752,308 | A * | 8/1973 | Begemann | B65D 77/02 | 206/256 |
| 4,738,359 | A | 4/1988 | Phillips | | |
| 4,932,534 | A | 6/1990 | Focke | | |
| 5,337,948 | A * | 8/1994 | Newsome | B65D 85/1072 | 206/745 |
| 5,351,820 | A | 10/1994 | Focke | | |
| 5,431,277 | A * | 7/1995 | Focke | B65D 85/1072 | 206/271 |
| 2012/0318690 | A1* | 12/2012 | Buse | B65D 85/1072 | 206/256 |
| 2013/0140199 | A1* | 6/2013 | Bellamah | B65D 85/1036 | 206/256 |
| 2013/0213834 | A1* | 8/2013 | Koster | B65B 19/025 | 206/256 |
| 2020/0283224 | A1* | 9/2020 | Draghetti | B65D 85/1081 | |

* cited by examiner

SPACING SUPPORT FOR PACKETS FOR SMOKING ARTICLES, SPACING KIT, PACKAGE CONTAINING SAID SPACING KIT AND METHOD TO ASSEMBLE A SPACING KIT

This application is a U.S. National Stage Application of International Application No. PCT/EP2019/064139 filed May 30, 2019, which was published in English on Dec. 5, 2019 as International Publication No. WO 2019/229212 A1. International Application No. PCT/EP2019/064139 claims priority to Italian Application No. 1020180005837 filed May 30, 2018.

The present invention relates to a spacing support for packets of smoking articles. The spacing support is in particular configured to accommodate a plurality of packets of smoking articles arranged in an orderly manner on two adjacent rows.

The present invention also relates both to a kit comprising the aforesaid spacing support and to the plurality of packets accommodated therein, and to a box-like package, which encloses the spacing support with the packets, and to the method for assembling the aforesaid kit.

PRIOR ART

According to current legislation, smoking articles are subject to special taxation by government authorities. This tax regime applies both to traditional smoking articles, such as cigarettes, cigars, cigarillos, fine-cut tobacco for cigarettes, and to electronic cigarettes, that is those inhalers or vaporisers the operation of which does not entail the direct combustion of tobacco.

From a practical point of view, the tax on these articles is executed by applying a government stamp on the outside of the packet containing the smoking articles.

The methods of application of this government stamp are many and vary according to reference national legislation.

In many countries, the government stamp is applied to the packet directly by the producer of smoking articles. To this end, the producer is equipped with the suitable devices to apply the stamp on the packet, after it has been formed and closed around an organised set of smoking articles. Sometimes, the same automatic packaging machine is equipped with a processing station dedicated to the application of the stamp. In this case, the stamp application station is built according to the needs of the producer, being designed and sized based on the specific type of packets processed by that particular packaging machine.

In other countries, the regulation provides that the government stamp is, instead, directly applied to the packets by the competent government body. This means that the producer of smoking articles, after having produced and packaged them, sends them to the government site for the application of the stamp. Here, the box-shaped packages that enclose the packets are temporarily opened and placed on a printing machine, in which special print heads apply the stamps on the packets. Subsequently, the packages are closed and returned to the producer for subsequent marketing.

A drawback of the procedure for applying the stamp executed by the government body, and not by the producer of the smoking articles, is that of being long and expensive, in terms of time and money.

An example of a box-like package for packets of smoking articles suitable to be subjected to the aforesaid procedure for applying the government stamp is described by U.S. Patent No. US-A-4,932,534.

This prior document describes a blank wrapped around a plurality of packets for smoking articles. The blank is shaped so as to define two compartments for housing the packets, which are joined to make two rows of packets side by side. United States patent US-A-4,932,534 provides that the blank is formed in such a way that the two different housing compartments can be separated from one another, if necessary, to define two half-packages, each accommodating half of the packets overall housed in the blank, that is a row of five packets.

In each housing compartment, the packets are arranged side by side so that their respective side walls are in mutual contact, leaving exposed a back wall of the packets on which the government stamp is affixed, after the resealable flaps of the box-like package containing the blank and the packets have been opened.

To overcome the aforementioned drawback, by attempting to make the application phase of the government stamp quicker and easier, then another package for smoking article packets has been developed, which is described by U.S. Patent No. US-A-5,351,820.

The package described in this document comprises a plurality of apertures, or notches, made directly on the package that wraps the packets at the bottom wall on which the government stamp is to be affixed. In this way, the latter can be applied without the need to open a box-like casing arranged around the package in which the packets are arranged.

A drawback of this package is that the notches weaken the structure.

Since in government printing machines the position of the print heads is fixed, they are able to correctly apply the government stamp only on a single type of packets for smoking articles, having a parallelepiped shape and standard size. For example, the standard size of the top wall, or the bottom wall, onto which the stamp is usually applied, are 22.5×56 mm.

A drawback encountered during the process of applying the government stamp through the printing machines known in the art is that they are not able to correctly affix the stamp in the position provided on a set of special packets, for example having their size different from the standard one indicated above.

At present, the blanks or packages known in the art are not able to support packets for smoking articles during the procedure for applying the government stamp in an efficient and flexible manner. In fact, the blanks and packages known in the art are not suitable for supporting special packets, that is having their size different from the standard one, and for ensuring at the same time the correct execution of the application phase of the government stamp.

There is therefore a need to make available a support for packets for smoking articles, capable of overcoming at least one of the drawbacks of the prior art.

An object of the present invention is to provide a spacing support for packets for smoking articles, which allows the packets to be held firmly in place during one or more processing steps or during transport and storage or during both. It is therefore an object of the present invention to provide a spacing support for packets of smoking articles capable of supporting the packets at least during the procedure for applying, or printing, the government stamp thereon.

Another object of the present invention is to provide a spacing support able to keep the packets positioned in an orderly manner inside a box-like package.

A further object of the present invention is to provide a spacing support capable of supporting "special" packets, i.e. having different sizes from the standard packet sizes.

One of the aims of this invention is also to provide a spacing support by means of which it is possible to use the same equipment known in the art, in particular the same printing machines, also for applying the government stamp on "special" packets having sizes or shapes or both shapes and sizes different from the standard ones.

A still further object of the present invention is to provide a spacing support for packets of smoking articles that is robust and reliable, as well as cheap and simple to manufacture.

To obviate the drawbacks of the prior art and to achieve these and further objects and advantages, the Applicant has studied, tested and manufactured the spacing support for packets of smoking articles according to the present invention, the kit and the box-like package, which comprise it, furthermore developing the method for assembling a spacing kit in accordance with the principles of the present invention.

SUMMARY OF THE INVENTION

The present invention is expressed and characterised in the independent claims. The dependent claims describe other characteristics of the present invention or variants of the main solution idea.

The embodiments described herein refer to a spacing support for packets for smoking articles configured to support in an orderly manner a plurality of packets arranged on two adjacent rows. In accordance with an embodiment, the spacing support comprises two containing drawers arranged adjacent to each other and each defining a respective housing for a corresponding row of packets, which extends along a longitudinal direction.

Each containing drawer comprises a bottom wall from which a pair of side walls extends, each of these walls being configured to come into contact with a respective packet wall; the containing drawer also comprises an access aperture through which the packets can be introduced and extracted from the housing.

According to some embodiments, at least one of the two side walls comprises a plurality of positioning elements projecting toward the inside of the housing and made as pre-cut fins integrated into the side wall; such positioning elements are configured to delimit positioning compartments in which each of said packets is stably arranged and held in a static manner, along the aforesaid longitudinal direction, with respect to said housing, that is preventing movements of the packets in the aforesaid longitudinal direction.

In accordance with the embodiments, the aforesaid positioning elements are provided one after the other at a distance, measured in the aforesaid longitudinal direction, which is equal to a predetermined and constant value, so as to arrange and hold the packets in their respective positioning compartments at a constant pitch with respect to each other, which is coordinated with said distance.

According to one embodiment, a side wall of a containing drawer is overlapped on, and comes into contact with, a corresponding side wall of the other containing drawer, and the inner surfaces of said side walls facing the housing are arranged according to a configuration of symmetry with respect to each other with reference to a centreline, which cuts longitudinally the bottom wall and extends parallel to the longitudinal direction.

In a preferred embodiment, a centre distance, measured in a transverse direction, which is substantially orthogonal to the longitudinal direction that has a predetermined and constant value, is defined between the centrelines of the bottom walls of the two containing drawers.

According to another aspect of the present invention, a spacing kit for packets for smoking articles is provided and is configured to support a plurality of packets arranged on two adjacent rows in an orderly manner; these include:

- a plurality of packets for smoking articles, each having a parallelepiped shape and comprising two opposite side walls of greater extension, two opposite side walls of smaller extension, a lower wall and a top wall,
- two containing drawers adjacent to each other, which each define a housing extending in a longitudinal direction and containing a row consisting of multiple packets.

According to some embodiments provided herein, each containing drawer comprises a bottom wall, intended to come into contact with one of the side walls of smaller extension of said packet, and a pair of side walls each overlapping respective side walls of greater extension of the packets arranged in the same row. The two side walls and the bottom wall are joined so as to define an access aperture of said containing drawer by means of which the packets can be introduced and extracted from the housing, the packets being accommodated in the latter so that the other side wall of smaller extension of the packets is exposed and accessible directly from the outside at the access aperture.

According to some embodiments, at least one of the two side walls comprises a plurality of positioning elements projecting toward the inside of the housing and made as pre-cut fins integrated into the side wall; the positioning elements being configured to delimit positioning compartments in which each of said packets is stably arranged and held in a static manner, along said longitudinal direction, with respect to said housing, that is preventing movements of the packets in said longitudinal direction. The aforesaid positioning elements are arranged one after the other at a fixed distance, which is at least equal to or greater than a typical size of the packet, measured in the said longitudinal direction, defined as the height of the side walls of smaller and greater extension, so as to arrange and hold the packets in their respective positioning compartments at a constant pitch with respect to each other, which is coordinated with said distance.

According to an embodiment, the spacing support, that is the containing drawers that compose it, is made of corrugated cardboard having a uniform thickness preferably equal to about 3.5 mm.

According to an embodiment of the kit according to the present invention, each row consists of five packets, spaced apart from one another in the aforesaid longitudinal direction by an interspace in correspondence of which the aforesaid positioning elements are made.

In one embodiment, the side walls and the bottom wall of the housing are integrated into a single body, separated from each other by folding lines.

In an embodiment of the spacing support, the two containing drawers are configured as separate and distinct elements which, in use, are brought closer together to be introduced into the box-like package.

In another embodiment, alternative to the previous one, the two containing drawers are produced as integrated into a single body, two side walls of their respective containing drawers being joined along a creasing line, which extends parallel to the longitudinal direction and defines a hinge around which each containing drawer can rotate at a certain angle with respect to the other containing drawer.

According to a still further aspect of the present invention, a method for assembling a spacing kit according to the present invention is provided, and includes the following steps:

forming two containing drawers by folding respective contiguous and adjacent "U"-shaped walls along folding lines to obtain a housing for a row of packets of smoking articles, said walls comprising a bottom wall and two side walls that extend from said bottom wall, bringing closer together the two previously assembled containing drawers, so that the two respective housings extend parallel to each other and to an extension longitudinal direction of the housings, introducing an ordered group of packets of smoking articles into the two housings by thrusting means, after the introduction step, deforming, through deforming means, certain portions of at least one side wall of each containing drawer, the portions being arranged in succession in the longitudinal direction so as to be separated from each other by a distance, measured in the longitudinal direction, which is equal to a predetermined and constant value, in order to obtain respective positioning elements.

According to a preferred embodiment, during the deformation step, retracting the thrusting means away from the packets is provided with a movement correlated between the thrusting means and the deforming means so that upon the gradual release of the thrusting means from the packets corresponds, as the aforesaid portions are deformed, a gradual introduction of the positioning elements inside the housings.

An advantage of the spacing support, of the kit and of the box-like package which comprise it, in accordance with the principles of the present invention, is that of firmly holding an ordered group of packets of smoking articles, for example according to a configuration that provides two adjacent rows each consisting of five packets.

Another advantage of the spacing support, and according to the present invention, is that it allows to keep the packets of the same row at a desired constant distance with respect to one another, in the longitudinal direction. Advantageously, the spacing support is shaped so as to keep homologous packets, arranged in corresponding positions of the two different rows, spaced apart by a desired and constant distance. In other words, each packet accommodated in a housing of a containing drawer is spaced from the homologous packet next to it and accommodated in its respective housing of the other containing drawer of a desired and constant distance, measured along a transverse axis, which is substantially orthogonal to the aforesaid longitudinal direction.

An advantage of the spacing support according to the present invention is therefore that of defining "centring" means by which each packet is located at a desired reference position. It is clear that this is particularly advantageous because it helps the automatic execution of processing steps, which must be performed on the packets. For example, due to the spacing support according to the present invention, the step of applying a government stamp on one of the walls of packets for smoking articles can be executed by means of printing machines known in the art, regardless of the sizes and shapes of the packets, without these machines needing particular preliminary adaptations or adjustments.

Arranging the packets for smoking articles in a spacing support according to the present invention is therefore advantageous because it allows to bring back any "special" packet, regardless of its size, to a "standard" or traditional packet, so that it can be processed by most, or all, of the equipment and machinery widespread in the smoking articles sector, without the need for lengthy and laborious adaptation or set-up operations, and above all without requiring the purchase of special machinery able to process only a particular packet size.

Another advantage of the spacing support according to the present invention is that it is economical and easy to produce.

A still further advantage of the spacing support according to the present invention is that it is robust and resistant.

In fact, it is preferably made of corrugated cardboard, that is an economic material, which at the same time has good mechanical strength characteristics.

A further advantage of the spacing support according to the present invention is that it is light and compact, which is important in order not to significantly increase transport and storage costs, which are typically proportionate to the weight or volume or both weight and volume of the items to be transported or stored.

A still further advantage of the spacing support according to the present invention is that it is ecological because, due to the fact that it is preferably made of corrugated cardboard, without any type of insert made of different materials, it can be considered a differentiable waste capable of being recycled after use.

A still further advantage of the spacing support according to the present invention is that it does not spoil, from an aesthetic viewpoint, the kit according to the present invention. In fact, since the spacing support is configured to remain inside the box-like package, even when it is distributed and marketed, it is obvious that the fact that the spacing support is not unpleasing to the eye is advantageous.

An advantage of the method for assembling a spacing kit, according to the present invention, is that it is intuitive, simple to implement and has reduced cycle times, which allow the kit to be assembled more rapidly than in the prior art.

These and other aspects, characteristics and advantages of the present disclosure will be better understood with reference to the following description, drawings and the appended claims. The drawings, which are integrated and a part of the present description, illustrate some embodiments of the present object and, together with the description, are intended to describe the principles of the disclosure.

The various aspects and characteristics described in the present description can be applied individually, where possible. These individual aspects, for example aspects and characteristics present in the description or in the appended dependent claims, may be the object of divisional applications.

Please note that any aspect or characteristic found to be already known during the patenting process is intended not to be claimed and be the object of a disclaimer.

DESCRIPTION OF THE DRAWINGS

These and other characteristics of the present invention will become clear from the following description of embodiments, with the related methods, provided by way of non-limiting example, with reference to the accompanying drawings in which.

To help understanding, identical reference numbers have been used, where possible, to identify identical common elements in the figures. It should be understood that elements and characteristics of an embodiment can conveniently be incorporated in other embodiments without further clarifications.

DESCRIPTION OF THE EMBODIMENTS

Reference will now be made in detail to the various embodiments of the invention, of which one or more examples are illustrated in the appended figures. Each example is provided by way of illustration of the invention and is not intended as a limitation thereof. For example, the characteristics illustrated or described as being part of an embodiment can be implemented on, or in association with, other embodiments to produce a further embodiment. It is understood that the present invention will include these changes and variations.

The embodiments described herein with reference to the figures refer to a spacing kit for packets of smoking articles, which is generally indicated with the reference number 10.

The spacing kit 10 comprises a spacing support 11 and a plurality of packets for smoking articles, generally indicated with the reference number 100.

Figure 1:
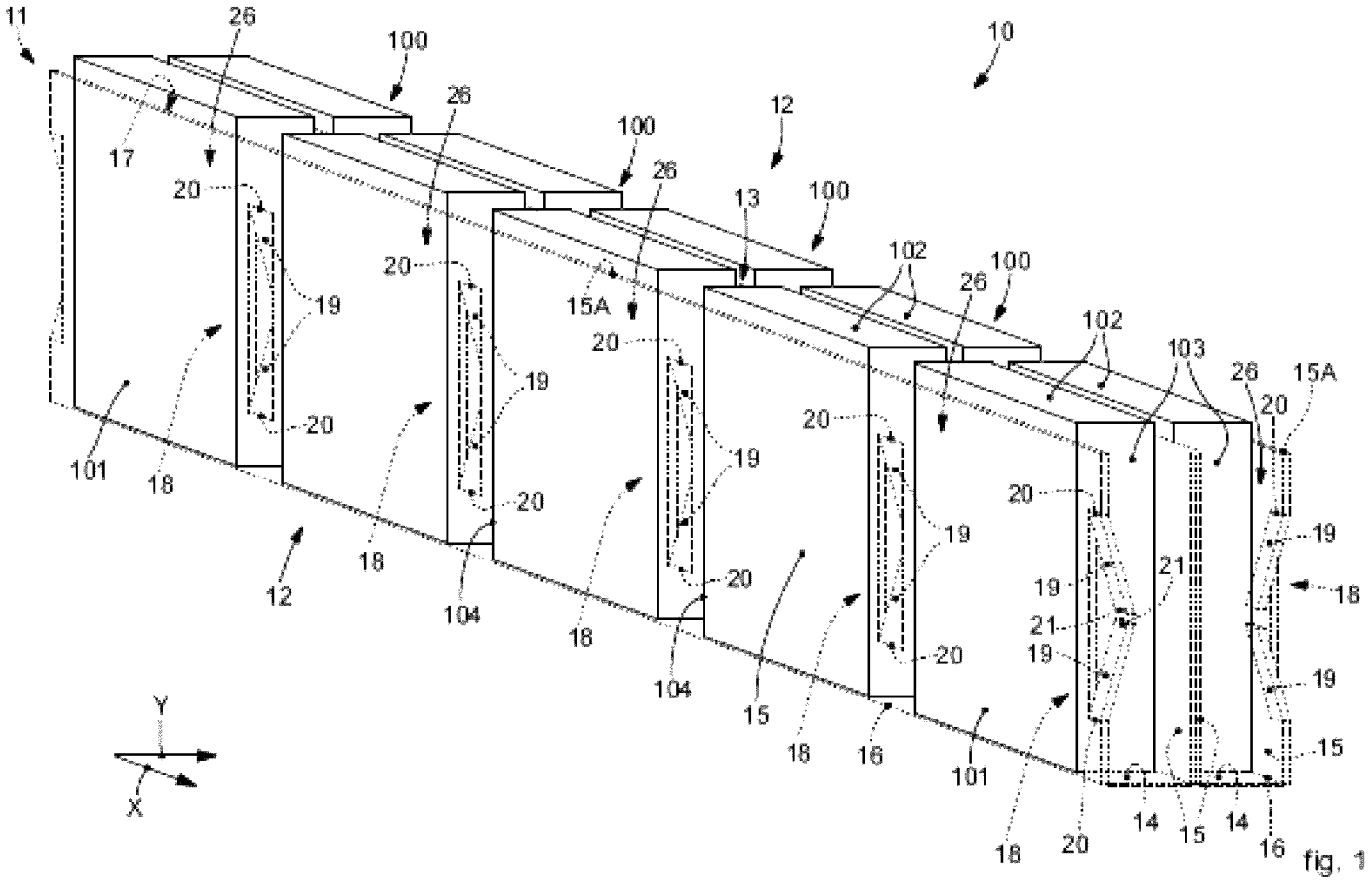
FIG. 1 is a schematic perspective view of a kit, according to the present invention, comprising a spacing support for packets of smoking articles, and a plurality of packets housed in the spacing support.
Figure 5:
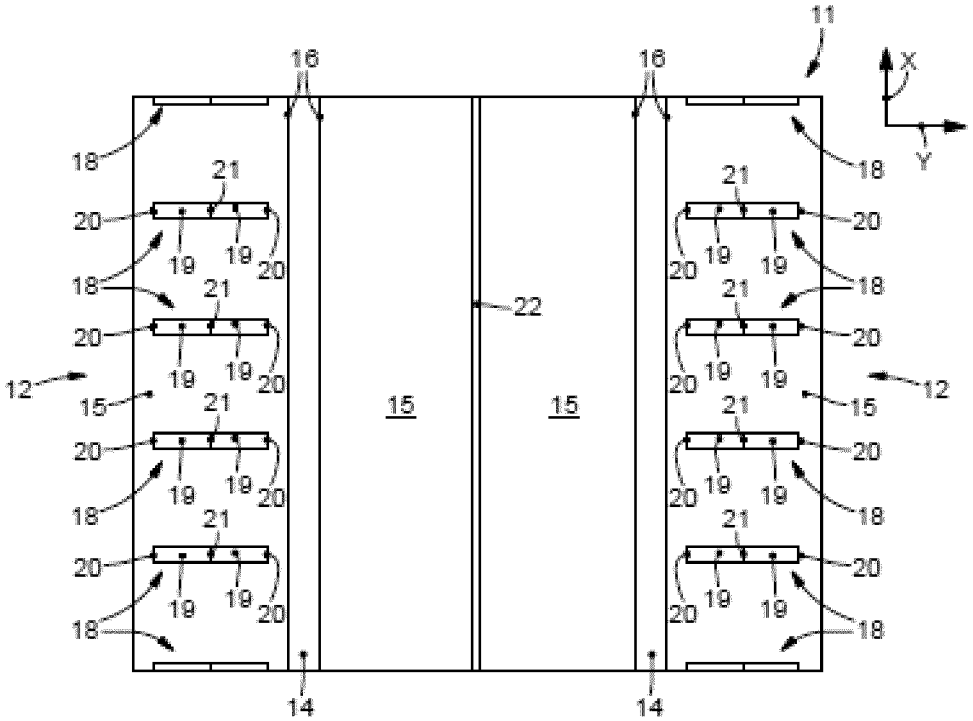
FIGS. 5 and 6 are top plan views of design variants of a spacing support according to the present invention, in which the plan development of the spacing support is visible.

As better shown in FIGS. 1 and 5, each packet 100 has a parallelepiped shape and comprises two opposite side walls of greater extension 101, two opposite side walls of smaller extension 102, a lower wall 103 and a top wall 104.

Preferably, the size of a packet 100 suitable for being supported by spacing support 11 are equal to 15.5×48 mm, meaning with these values, respectively, the width and the height of the side walls of smaller extension 102.

According to some embodiments described herein, spacing support 11 comprises two containing drawers, each indicated with reference number 12, arranged adjacent with respect to one another.

Each containing drawer 12 defines a respective housing 13 for a corresponding row of packets of smoking articles 100.

According to some embodiments provided herein, containing drawer 12, and the housing 13 defined by it, extend in a longitudinal direction X.

In a preferred embodiment, each row comprises five packets of smoking articles 100.

In some embodiments, each containing drawer 12 comprises a bottom wall 14, and a pair of side walls 15, which extend from bottom wall 14. In particular, the side walls 15 are adjacent to the bottom wall 14 and joined to the latter by folding lines 16, which extend parallel to the longitudinal direction X.

Each wall of the containing drawer 12, that is the bottom wall 14 and the pair of side walls 15, is configured to come into contact with a respective wall of packet 100.

For example, the pair of side walls 15 overlaps and comes into contact with the side walls of greater extension 101 and the bottom wall overlaps and comes into contact with one of the side walls of smaller extension 102. In this case, the packet 100 is accommodated in the housing 13 oriented so that a direction of prevalent longitudinal development of the packet is orthogonal with respect to the longitudinal direction X.

According to some embodiments, the containing drawer 12 comprises an access aperture 17 through which the packets 100 can be introduced and extracted from the housing 13.

Figures 2, 3A, 3B, 4:
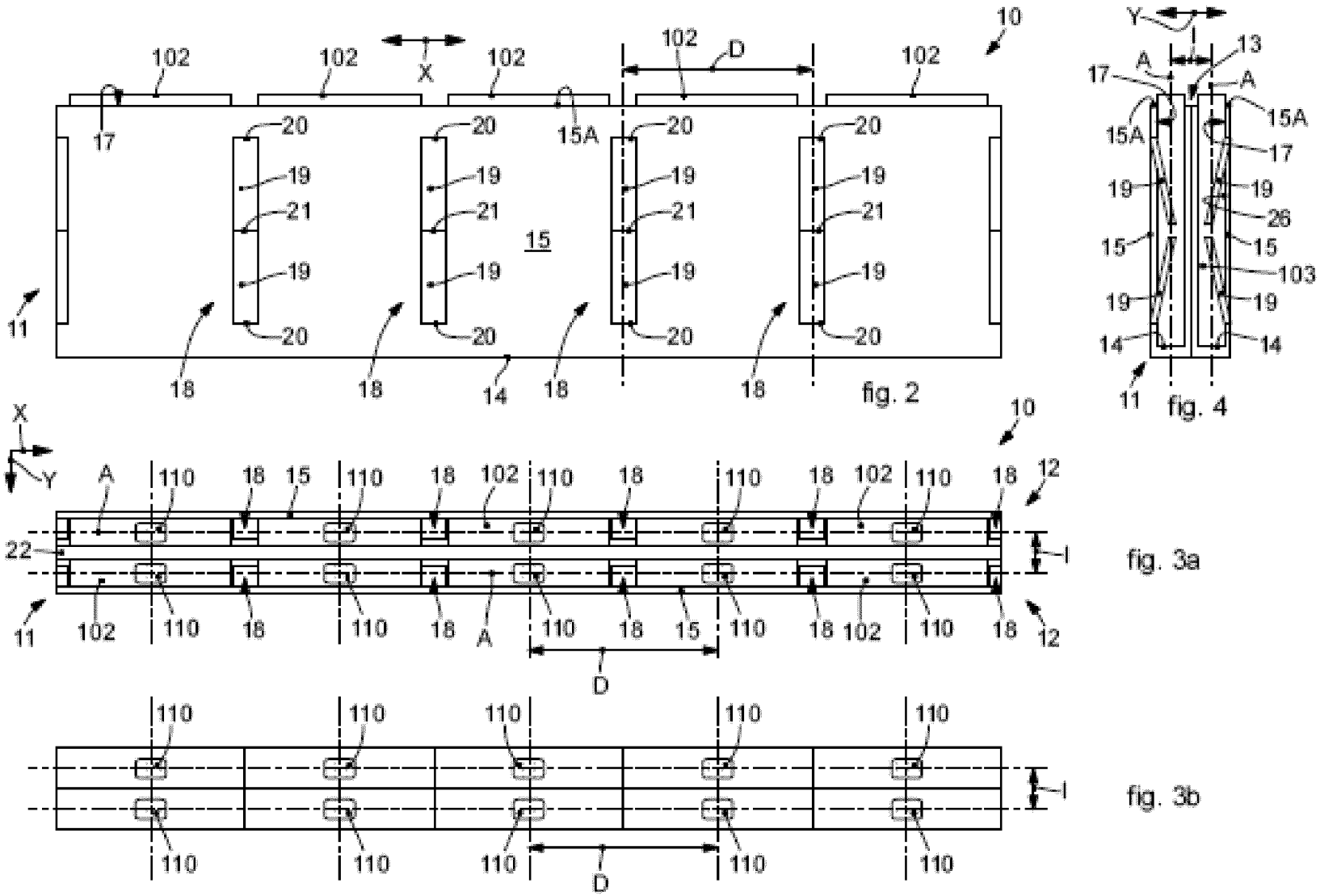
FIG. 2 is a side elevation view of the kit of FIG. 1.
FIG. 3*a* is a top plan view of the kit of FIG. 1.
FIG. 3*b* is a schematic, top plan view of a group of packets of smoking articles of the type known in the art.
FIG. 4 is a front elevation view of the kit of FIG. 1.

As better shown in FIG. 4, the bottom and side walls 14, 15 are arranged one with respect to the others so that each containing drawer 12 is "U"-shaped, where the open end of the "U" defines the access aperture 17. It should be noted that the packets 100 are oriented in such a way that the other side wall of smaller extension 102 is arranged near the access aperture 17. In particular, as better shown in FIGS. 2 and 4, this side wall of smaller extension 102 projects beyond an end edge 15A of the side wall 15 arranged on the opposite side with respect to the bottom wall 14. In this way, the side wall of smaller extension 102 of the packets 100 remains exposed and easily accessible to perform the necessary processes on it, such as for example the application of the government stamp.

Figure 9:
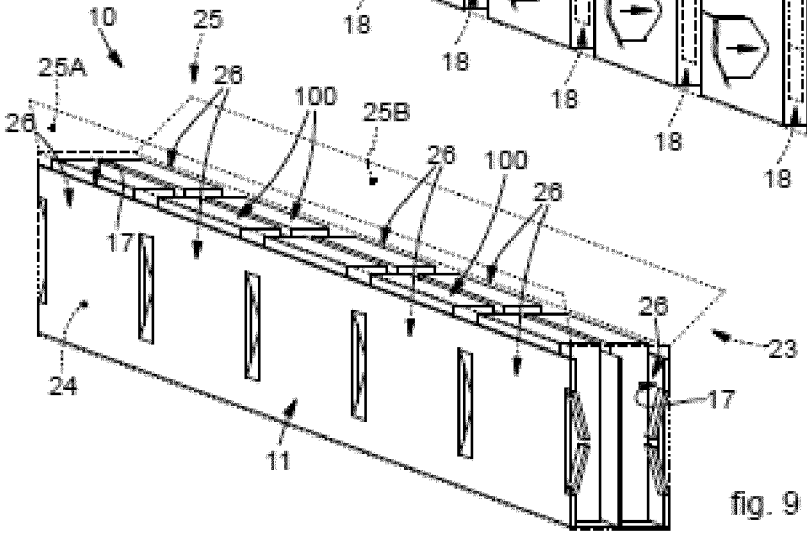
FIG. 9 is a schematic perspective view of the kit of FIG. 1, arranged inside a box-like package enclosing it.

According to some embodiments provided herein, at least one of the side walls 15 comprises a plurality of positioning elements 18 projecting towards the inside of the housing 13 and configured to delimit the positioning compartments 26 (see for example FIGS. 1, 4 and 9), in which each of said packets 100 is stably arranged and held in a static manner, in said longitudinal direction X, with respect to said housing 13, that is preventing its movement in the longitudinal direction X.

The packets 100, in particular, can be introduced and extracted with respect to the positioning compartments 26 through the aforementioned access aperture 17.

In a preferred embodiment, the positioning elements 18 are made as pre-cut fins 19, integrated into the side wall 15.

According to an embodiment, each positioning element 18 consists of a pair of fins 19. Each fin 19 is joined to the side wall 15 by a respective joining line 20, while the fins are separated from one another by a cutting line 21. The joining lines 20 and the cutting line 21 are mutually parallel to each other and are also parallel to the longitudinal direction X.

In an alternative embodiment, not shown, each positioning element 18 can consist of a single fin 19. In this case, the fin 19 can extend from a joining line 20, which connects it to the side wall 15, up to the end edge 15A.

According to the embodiment in which each housing is intended to accommodate a row of five packets 100, six positioning elements 18 are provided. In particular, four positioning elements 18 are interposed between two adjacent packets 100, and the remaining two positioning elements 18 are arranged at opposite ends of the side wall 15 so as to hold the outermost packet 100 arranged at the end of the row.

In other words, an interspace separating two adjacent packets 100 is defined at the positioning elements 18. This interspace is at least equal to, or slightly greater than, the width of the fins 19, measured parallel to the longitudinal direction X.

In the embodiments provided herein, the positioning elements 18 are arranged one after the other at a distance D, measured in the longitudinal direction X, which is equal to a predetermined and constant value, so as to arrange and hold the packets 100 in their respective positioning compartments 26 at a constant pitch with respect to each other, which is coordinated with said distance.

In a preferred embodiment, the distance D is at least equal to or greater than a characteristic size of the packet 100, preferably defined as the height of the side walls of greater and smaller extensions 101, 102. In the example described here, the distance D is therefore at least equal to or greater than 48 mm.

According to some embodiments described herein, a side wall 15 of a containing drawer 12 overlaps, and comes into contact with, a corresponding side wall 15 of the other containing drawer 12.

In a preferred embodiment, the two side walls 15, which overlap and comes into contact with each other are the side walls without the positioning elements 18, the latter being made on the other side walls 15 of the containing drawers 12, which remain visible and accessible from the outside.

It should be understood that in other embodiments, the positioning elements 18 can be made on both side walls 15 of a containing drawer 12, or they can be made on the side walls 15 of two adjacent containing drawers 12, and overlapped on each other, or still they can be made on the outer wall of a containing drawer 12, and on the inner wall of the other containing drawer.

According to a preferred embodiment, the inner surfaces of the side walls 15 facing towards the inside of the housing 13 are arranged according to a configuration of symmetry with respect to one another with reference to a centreline axis A of the bottom wall 14, which extends parallel to the longitudinal direction X.

In an embodiment, a centre distance I, measured in a transverse direction Y, which is substantially orthogonal to the longitudinal direction X having a predetermined and constant value, is defined between the centrelines A of the bottom walls 14 of the containing drawers 12. For example, the centre distance I can be approximately equal to 22.5 mm.

Figure 6:
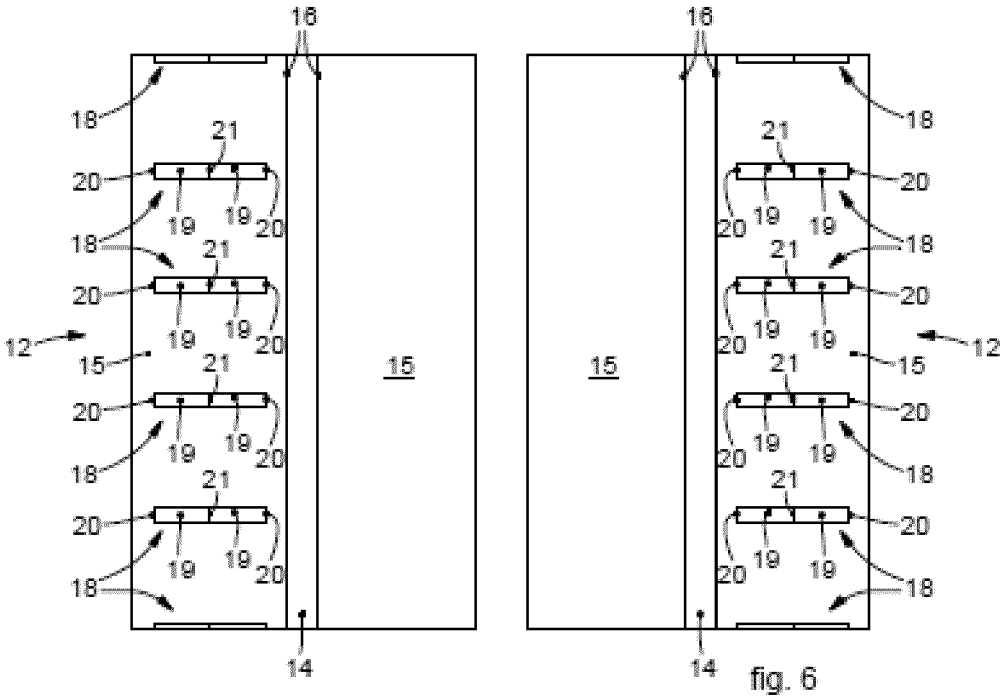

In FIGS. 5 and 6 show two alternative embodiments of the spacing support 11.

According to a first embodiment (FIG. 5), the two containing drawers 12 are integrated into a single body. In this case, two side walls 15 of as many containing drawers 12 are joined along a creasing line 22 defining a hinge around which each containing drawer 12 can rotate by a certain angle with respect to the other containing drawer 12.

In accordance with a second embodiment (FIG. 6), alternative to the previous one, the two containing drawers 12 are configured as separate and distinct elements which, in use, are brought closer together in the manner described above, that is completely overlapping two side walls 15 of the various containing drawers 12 one above the other.

According to the various embodiments described herein, the spacing support 11, that is the containing drawers 12, are made starting from sheet material, for example paper, cardboard or paperboard having a suitable thickness to ensure the necessary mechanical strength.

In a preferred embodiment, the spacing support 11, and therefore the containing drawers 12 are made of corrugated cardboard having a homogeneous thickness of about 3.5 mm.

In other embodiments, the spacing support 11, and therefore the containment drawers 12, can also be made of materials other than those mentioned above, such as for example plastic.

The spacing kit 10 described above is configured to be introduced into a box-like package 23 (FIG. 9) having a body 24 configured to receive the spacing kit 10 (that is the spacing support 11 and the plurality of packets 100) which can be closed in a reclosable manner by a lid 25 consisting of two flaps 25A, 25B hinged to body 24.

The flaps 25A, 25B can be opened to have access inside the box-like package 23, for example to collect the packets 100 or to perform on them one or more processes, such as the application of the government stamp, and subsequently shut again to close the box-like package 23.

In one embodiment, an outer wrapping (not shown) is provided wrapped around the box-like package 23. The outer wrapping hermetically encloses the box-like package 23 and is applied at the end of all the processes, when the package is ready to be stored or shipped for subsequent marketing. The outer wrapping can for example consist of a thin and transparent film, for example made with polymeric materials known in the art (cellophane or similar).

Figure 7:
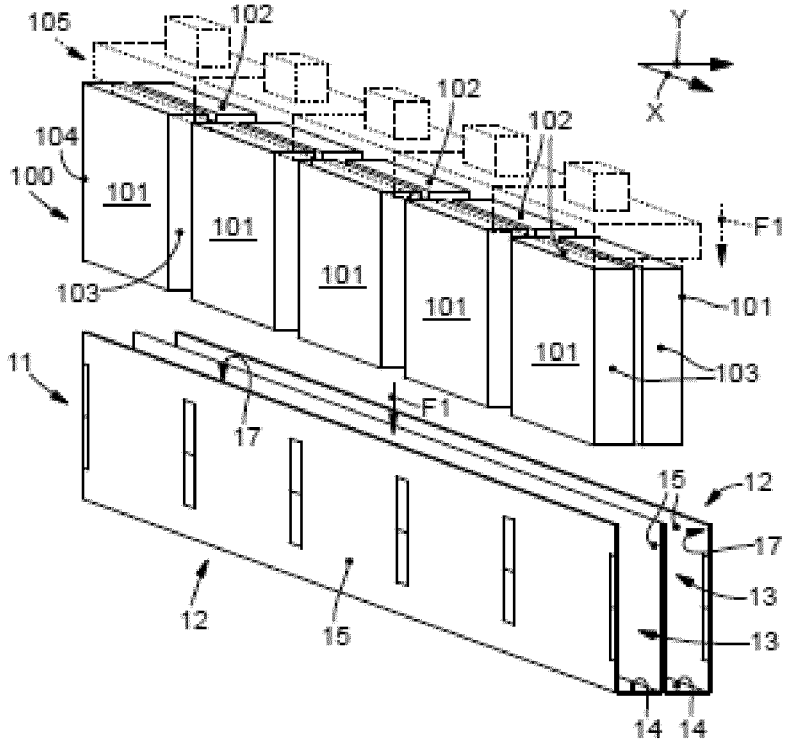
FIGS. 7 and 8 are schematic perspective views, which illustrate a sequence of operating steps included in a method for making the kit of FIG. 1.
Figure 8:
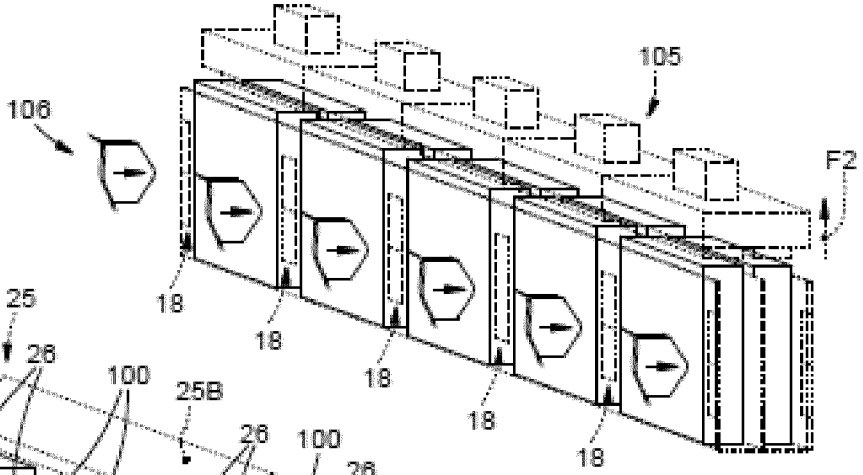

With reference to FIGS. 7 and 8 a method for assembling a spacing kit 10 according to the present invention is now described.

In a first step, forming the two containing drawers 12 is required. In this step, providing the containing drawer 12 with the "U" shape by folding the side walls 15 with respect to the bottom wall 14 along the folding lines 16 so as to obtain the housing 13, is required.

In a second step, bringing closer together the two containing drawers 12 assembled in the previous step is required, so that the two housings 13 extend parallel to each other and to the longitudinal direction X.

In a third step, introducing an ordered group of packets of smoking articles 100 within the two housings 13 by the action of one or more thrusting members 105, which have been schematised with a dashed line in FIGS. 7 and 8, is required. As indicated by the arrows F1, preferably the spacing support 11 is kept stationary, while the thrusting members 105 move the group of packets 100 towards it.

Preferably, the thrusting members 105 have a shape complementary to that of the packets 100, not only finding the side wall of smaller extension 102 facing them, but also, at least partially, the lower wall 103 and the top wall 104. According to some embodiments, the thrusting members 105 can therefore have a "comb-like" configuration, with a base portion intended to find the side wall of smaller extension 102, and elongated portions (not shown), which extend from the base wall by penetrating into the spaces between two adjacent packages.

After the third introduction step, the method comprises a fourth step in which deformation is required, through deforming members 106 schematised in FIG. 8 as tips or punches, determined portions of at least one of the side walls 15 comprised in each containing drawer 12.

The portions of the side wall 15 that are deformed in the fourth step are intended to define the positioning elements 18.

Consequently, the portions being deformed are arranged in succession in the longitudinal direction X so as to be separated, one from the other, from the aforesaid distance D.

According to a preferred embodiment, during the fourth step, retracting the thrusting members 105 away from the packets 100 (arrow F2 in FIG. 8), so that there is a correlated movement between the thrusting members 105 and the deforming members 106, so that the gradual release of the thrusting members 105 from the packets 100 corresponds, as the portions are deformed, to a gradual introduction of the positioning elements 18 inside housings 13.

In this way, the packets 100 are always held and constrained, to prevent their relative movement with respect to the spacing support 11, initially by the thrusting members 105, and subsequently by the positioning elements 18, which define their respective positioning compartments 26.

With reference to FIGS. 3*a* and 3*b*, a method of use of the support and the spacing kit 11, 10 according to the present invention is briefly illustrated below, with particular reference to the application step of a government stamp, indicated with the reference number 110, on the packets of smoking articles 100.

FIG. 3*b* shows an ordered group of packets of traditional smoking articles, ordered according to two overlapped rows of five packets each.

FIG. 3*a*-3*b* allow to visually, immediately and intuitively compare the situation presented by using a spacing support 11 according to the present invention, which accommodates a plurality of "special" packets 100, having a smaller size than the standard size of traditional packets (FIG. 3*a*), in comparison with the recurring situation in the prior art, in which the government stamp 110 must be applied to a group of packets of traditional smoking articles, without the spacing support 11 (FIG. 3*b*).

As can be seen from the comparison between the figures, the outermost profile of the spacing support 11 delimits an area, which is identical to the total area occupied by the group of traditional packets. In other words, the spacing support 11 is shaped and sized in such a way as to compensate for the lower volumes occupied by the "special" packets so that the latter, when received by the spacing support 11, substantially occupy the same volumes as a group of traditional packets.

Moreover, from the comparison between the figures it is also possible to notice that the position of the government stamps remains unchanged in both cases. Due to the presence of the spacing support 11, the two-dimensional spatial "coordinates" in the X and Y directions of the government stamps 110, applied to the packets 100, remain identical to the corresponding "coordinates" of the homologous government stamps applied on traditional packets of smoking articles.

As shown in figures FIGS. 3*a*-3*b*, the distance, or centre distance, between the center of two government stamps 110 applied on two adjacent packets 100 is substantially equal to the distance D in the longitudinal direction X, and to the centre distance I, in the transverse direction Y.

It is evident that the shapes, the dimensional values and the thicknesses mentioned in the present description are merely illustrative, and can be modified, without thereby departing from the scope of protection of the present invention, depending on the sizes and shapes of the packets of smoking articles to be accommodated in spacing support 11. In fact, as can be deduced from the description of the comparison between the FIGS. 3*a* and 3*b* mentioned above, the spacing support 11 has related sizes and thicknesses, in particular complementary to those of the packet 100, which it must support, in order to maintain the same total volumes of a group of traditional packets and to arrange the packets in positions, such that the government stamp can be applied in the same positions (or "coordinates") with respect to the conventional case.

It is clear that changes or additions or both changes and additions of parts or steps can be made to the support and to the spacing kit, to the method for assembling it and to the package enclosing it, without departing from the scope of the present invention.

It is also clear that, although the present invention has been described with reference to some specific examples, a person skilled in the art will certainly be able to realize many other equivalent forms of support and spacing kit, method and package, having the characteristics expressed in the claims and therefore all falling within the scope of protection defined by them.

In the claims that follow, the references in parentheses have the sole purpose of facilitating the reading and should not be considered as limiting factors with regard to the scope of protection implied in the specific claims.

The invention claimed is:

1. A spacing support for packets (100) for smoking articles configured to support in an orderly manner a plurality of packets arranged on two adjacent rows, and comprising two containing drawers (12) adjacent to each other and each defining a respective housing (13) for a corresponding row of packets, which extends in a longitudinal direction (X), wherein each containing drawer (12) comprises a bottom wall (14) from which a pair of side walls (15) extends, each side wall (15) adapted to come into contact with a respective wall (101, 102) of the packet (100), said containing drawer (12) also comprising an access aperture (17) through which the packets (100) are introduced and extracted with respect to housing (13), wherein at least one of said side walls (15) comprises a plurality of positioning elements (18) projecting towards the inside of said housing (13) and made as pre-cut fins (19) integrated into said side wall (15), said positioning elements (18) being configured to delimit positioning compartments (26), in which each of said packets (100) is stably arranged and held in a static manner, in said longitudinal direction (X), with respect to said housing (13), said positioning elements (18) being provided one after the other at a distance (D), measured in said longitudinal direction (X), equal to a predetermined and constant value, so as to arrange and hold the packets (100) in their respective positioning compartments (26), at a constant pitch with respect to each other, which is coordinated with said distance (D), wherein each of said positioning elements (18) consists of a pair of fins (19), each fin (19) being joined to said side wall (15) by a respective joining line (20), and the fins (19) of the same pair are separated from each other by a cutting line (21); wherein said joining lines (20) and said cutting line (21) are reciprocally parallel to each other and are also parallel to the longitudinal direction (X).

2. The spacing support according to claim 1, characterised in that one side wall (15) of one containing drawer (12) overlaps and comes into contact with a corresponding side wall (15) of the other containing drawer (12), the inner surfaces of said side walls (15) facing toward the inside of said housing (13) being arranged one with respect to the other according to a configuration of symmetry with reference to a centreline axis (A) of said bottom wall (14) that extends parallel to the longitudinal direction (X).

3. The spacing support according to claim 2, characterised in that between said centrelines (A) of the bottom walls (14) of said two containing drawers (12) a centre distance (I) is defined, measured in a transverse direction (Y), which is substantially orthogonal to the longitudinal direction (X), having a predetermined and constant value.

4. The spacing support according to claim 1, characterised in that said side walls (15) and said bottom wall (14) of said housing (13) are integrated into a single body, separated from each other by respective folding lines (16), wherein said side walls (15) and said bottom wall (14) are arranged one with respect to the others so that each containing drawer (12) is "U"-shaped, where the open end of the "U" defines said access aperture (17).

5. The spacing support according to claim 1, characterised in that said two containing drawers (12) are configured as separate and distinct elements configured to be brought reciprocally closer to each other so that one of said side walls (15) of one containing drawer (12) almost completely overlaps a respective side wall (15) of the other containing drawer (12).

6. The spacing support according to claim 1, characterised in that said two containing drawers (12) are integrated into a single body, two side walls (15) of respective containing drawers (12) being joined together along a creasing line (22), which extends parallel to the longitudinal direction (X) and defines hinge means around which each containing drawer (12) can rotate by a certain angle with respect to the other containing drawer (12).

7. The spacing support according to claim 1, characterised in that said containing drawers are made starting from sheet material, for example in corrugated cardboard having a homogeneous thickness approximately equal to about 3.5 mm.

8. A spacing kit comprising:

a plurality of packets (100) for smoking articles, each having the shape of a parallelepiped and comprising two opposite side walls of greater extension (101), two opposite side walls of smaller extension (102), a lower wall (103) and a top wall (104), two containing drawers (12) adjacent to each other, which each define a housing (13) extending in a longitudinal direction (X) and containing a row consisting of multiple packets (100), the packets (100) in the spacing kit thus being arranged on two adjacent rows and supported in an orderly manner, wherein each containing drawer (12) comprises a bottom wall (14), intended to come into contact with one of the side walls of smaller extension (102) of said packet (100), and a pair of side walls (15) each overlapping respective side walls of greater extension (101) of the packets (100) arranged in the same row, wherein said side walls (15) and said bottom wall (14) are joined so as to define an access aperture (17) of said containing drawer (12) by means of which the packets (100) can be introduced and extracted from the housing (13), the packets being accommodated in the latter so that the other side wall of smaller extension (102) of the packets (100) is exposed and accessible directly from the outside at the access aperture (17), wherein at least one of the two side walls (15) of each containing drawer (12) comprises a plurality of positioning elements (18) projecting toward the inside of said housing (13) and made as pre-cut fins (19) integrated into the side wall (15), said positioning elements (18) being configured to delimit positioning compartments (26) in which each of said packets (100) is stably arranged and held in a static manner, in said longitudinal direction (X) with respect to said housing (13), said positioning elements (18) being arranged one after the other at a fixed distance (D), which is at least equal to or greater than a typical size of the packet (100), measured in said longitudinal direction (X), defined as the height of the side walls of smaller and greater extension (101, 102), so as to arrange and hold the packets (100) in their respective positioning compartments (26) at a constant pitch with respect to each other, which is coordinated with said distance (D), wherein each of said positioning elements (18) consists of a pair of fins (19), each fin (19) being joined to said side wall (15) by a respective joining line (20), and the fins (19) of the same pair are separated from each other by a cutting line (21); wherein said joining lines (20) and said cutting line (21) are reciprocally parallel to each other and are also parallel to the longitudinal direction (X).

9. The spacing kit according to claim 8, characterised in that each row consists of five packets (100), said packets distanced from each other in said longitudinal direction (X) by an interspace in correspondence with which one of said positioning elements (18) is made.

10. The spacing kit according to claim 8, characterised in that said side wall of smaller extension (102), which is arranged in proximity to said access aperture (17) projects beyond an end edge (15A) of said side wall (15), which is arranged on the opposite side with respect to said bottom wall (14), so that said side wall of smaller extension (102) remains exposed and easily accessible.

11. A box-like package for packets (100) of smoking articles, characterised in that it comprises a body (24) which accommodates a spacing kit according to claim 8, and a lid (25) consisting of two flaps (25A, 25B) hinged to said body (24) and configured to close the box-like package in a reclosable manner.

12. The box-like package according to claim 11, characterised in that it comprises an outer wrapping, which encloses it hermetically, for example made of a polymer material.

13. A method to assemble a spacing kit according to claim 8, characterised in that it comprises the steps of:

making two containing drawers (12) by folding respective contiguous and adjacent walls (14, 15) in the shape of a "U" along folding lines (16) to obtain a housing (13) for a row of packets (100) of smoking articles, said walls comprising a bottom wall (14) and two side walls (15) that extend from said bottom wall (14), bringing closer together said two previously made containing drawers (12), so that the two respective housings (13) extend parallel to each other and both parallel to a longitudinal direction (X), introducing an ordered group of packets (100) of smoking articles within the two housings (13) by thrusting means (105), after the introduction step, deforming, through deforming means (106), positioning elements (18) of at least one of said side walls, each positioning element (18) consisting of a pair of fins (19), each fin (19) being joined to said at least one side wall (15) by a respective joining line (20), the fins (19) of a same pair being separated from each other by a cutting line (21).

14. The method according to claim 13, characterised in that, during the deformation step, retracting said thrusting means (105) away from the packets (100) is provided with a movement correlated between said thrusting means (105) and said deforming means (106), so that upon gradual release of said thrusting means (105) from the packets (100) corresponds, as said portions are deformed, a gradual introduction of said positioning elements (18) inside the housings (13).

* * * * *